US010207319B2

(12) United States Patent
Rotmann et al.

(10) Patent No.: US 10,207,319 B2
(45) Date of Patent: Feb. 19, 2019

(54) INSERT PART THAT CAN BE INFILTRATED

(71) Applicant: Mahle International GmbH, Stuttgart (DE)

(72) Inventors: Udo Rotmann, Marburg (DE); Roland Ruch, Schopfheim (DE); Patrick Sutter, Schopfheim (DE); Frank Winger, Stuttgart (DE)

(73) Assignee: Mahle International GmbH (DE)

( * ) Notice: Subject to any disclaimer, the term of this patent is extended or adjusted under 35 U.S.C. 154(b) by 114 days.

(21) Appl. No.: 14/909,017

(22) PCT Filed: Jul. 28, 2014

(86) PCT No.: PCT/EP2014/066168
§ 371 (c)(1),
(2) Date: Jan. 29, 2016

(87) PCT Pub. No.: WO2015/014787
PCT Pub. Date: Feb. 5, 2015

(65) Prior Publication Data

US 2016/0175927 A1 Jun. 23, 2016

(30) Foreign Application Priority Data

Jul. 31, 2013 (DE) ..... 10 2013 215 020

(51) Int. Cl.
*B22D 19/00* (2006.01)
*B22D 18/04* (2006.01)
(Continued)

(52) U.S. Cl.
CPC ..... *B22D 19/0027* (2013.01); *B22C 9/10* (2013.01); *B22D 18/04* (2013.01); *B22D 21/007* (2013.01);
(Continued)

(58) Field of Classification Search
CPC ..... B22D 19/0027; B22F 5/008; B22F 5/02; F02F 3/04–3/08
See application file for complete search history.

(56) References Cited

U.S. PATENT DOCUMENTS 2,753,859 A 7/1956 Bartlett
3,196,501 A * 7/1965 Balevsky ..... B22D 18/04 164/113
(Continued)

FOREIGN PATENT DOCUMENTS

DE 2639294 A1 3/1978
DE 3418405 A1 11/1984
(Continued)

OTHER PUBLICATIONS

English abstract for DE-102012101055.
(Continued)

*Primary Examiner* — Kevin E Yoon
*Assistant Examiner* — Jacky Yuen
(74) *Attorney, Agent, or Firm* — Fishman Stewart PLLC

(57) ABSTRACT

An insert part for a cast piston of an internal combustion engine may include a powder, such as a sintered powder material, containing at least iron or alloys thereof, and having a capacity for being infiltrated. The powder may contain particles having different grain sizes, and up to 4% by volume of the powder may include particles having a diameter smaller than 75 μm.

14 Claims, 1 Drawing Sheet

(51) Int. Cl.

| | |
|---|---|
| ***B22F 5/02*** | (2006.01) |
| ***B22C 9/10*** | (2006.01) |
| ***B22D 21/00*** | (2006.01) |
| ***B22F 3/10*** | (2006.01) |
| ***B22F 5/00*** | (2006.01) |

(52) U.S. Cl.
CPC ..... *B22F 3/10* (2013.01); *B22F 5/008* (2013.01); *B22F 2301/35* (2013.01)

(56) References Cited

U.S. PATENT DOCUMENTS

| | | | | |
|---|---|---|---|---|
| 4,334,507 | A | 6/1982 | Kohnert et al. | |
| 4,966,221 | A | 10/1990 | Takasuga et al. | |
| 2001/0030035 | A1* | 10/2001 | Oda | B22D 19/0027 164/100 |
| 2003/0156963 | A1* | 8/2003 | Lorenz | B22F 3/26 419/2 |
| 2005/0153156 | A1 | 7/2005 | Miyoshi et al. | |
| 2008/0060723 | A1* | 3/2008 | Doty | C22C 1/06 148/549 |
| 2012/0160206 | A1 | 6/2012 | Takahashi et al. | |

FOREIGN PATENT DOCUMENTS

| | | | |
|---|---|---|---|
| DE | 19635326 | A1 | 3/1997 |
| DE | 19712624 | A1 | 10/1998 |
| DE | 102004059203 | A1 | 9/2005 |
| DE | 102011122626 | A1 | 6/2012 |
| DE | 102012101055 | A1 | 8/2012 |
| EP | 1138418 | A2 | 10/2001 |
| JP | 02254132 | | 10/1990 |

OTHER PUBLICATIONS

English abstract for JP-02254132.
English abstract for DE-19712624.
English abstract for DE-19635326.
German Search Report for DE-102013215020.2, dated Mar. 17, 2014.

* cited by examiner

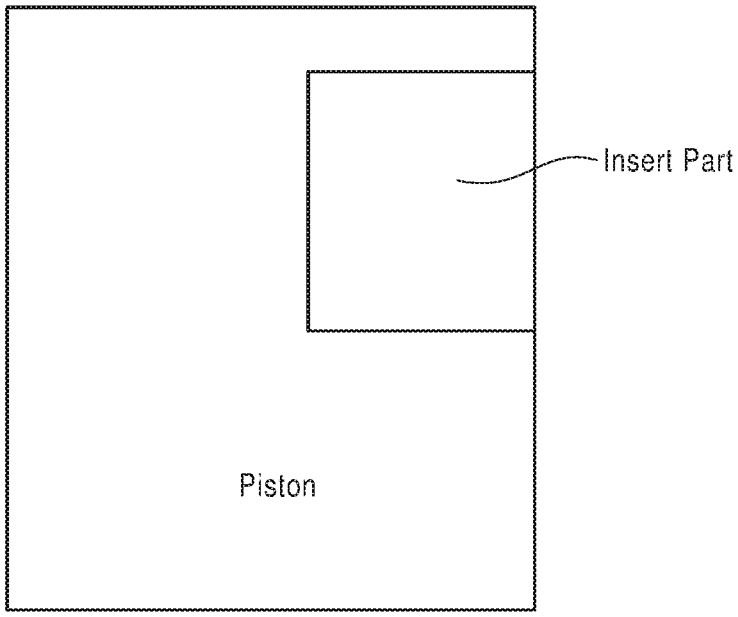
Insert Part
Piston

INSERT PART THAT CAN BE INFILTRATED

CROSS-REFERENCE TO RELATED APPLICATIONS

This application claims priority to International Patent Application PCT/EP2014/066168, filed on Jul. 28, 2014 and German Patent Application No. 10 2013 215 020.2, filed on Jul. 31, 2013, the contents of which are hereby incorporated by reference in their entirety.

TECHNICAL FIELD

The present invention relates to an insert part for a cast lightweight metal piston of an internal combustion engine, which insert part can be infiltrated. The invention further relates to a method for producing a lightweight metal piston using such an insert part.

BACKGROUND

Lightweight metal pistons have been in use in internal combustion engines for a long time because of their lower weight and reduced inertial forces. In order to protect particularly a first ring groove of such a lightweight metal piston, an aluminium piston, for example, from swelling pressure loads, reinforcements in the form of "ring carriers" are used. The materials from which such ring carriers may be made particularly include iron alloys, for example, that typically have a coefficient of expansion as similar as possible to that of the piston material. However, since for example iron and aluminium alloys have very different heat conducting capabilities, reversing thermal loads can cause strong stresses at the boundary surfaces, and these increase for growing differences between the coefficients of thermal expansion of the two materials, one being used for the piston and the other for the ring carrier. A crack that forms between that ring carriers and the piston typically causes the engine to break down and must therefore be prevented at all costs. The joint between the ring carriers and the piston is usually created with a metallic material in the known in Alfin process, in which the ring carriers is immersed in an aluminium melt until a diffusion layer has formed. Then, this "alfinised" ring carrier is surrounded by the melt of the piston alloy when the piston is cast, and the Alfin bond forms during the subsequent solidification.

Because of the high ignition pressures that prevail in modern diesel engines, practically of the pistons used for this are reinforced at the first ring groove with cast iron ring carriers, usually made from austenite. The trend towards direction fuel injection in petrol engines, combined with rising ignition pressures then also demands more effective wear resistance in the first ring groove than standard piston alloys can provide. At the same time the bond between the lightweight metal of the piston and the ring carrier cast therein is particularly important.

A composite die casting process for manufacturing aluminium pistons for internal combustion engines in which a ring carrier made from metal foam of nickel, copper, iron or alloys thereof having a volume fraction of 3-50% of the piston is infiltrated under a casting pressure of at least 392 bar in a high pressure die casting process to form the bond with the piston alloy is known from DE 34 18 405 C2. A metallurgical bond may be created in a subsequent, multi-stage heat treatment process, for example solution annealing, aging or the like.

From DE 196 35 326 A1, a method is known from manufacturing a lightweight alloy composite element in which initially a porous composite forming material is held in a hollow space of a casting mould. Then, a molten light alloy is cast in the hollow space of the casting mould by applying a gas pressure, which causes the pores of the porous composite forming material to be impregnated with the molten light alloy. As a result, a composite material section is created that is made from the lightweight alloy and the composite forming material.

In document DE 26 39 294 C2, various highly porous sinter materials with a chromium-nickel base and Cu, Ni, Fe, Ni—Fe-foam materials by infiltration under solidification pressures between 2500 and 1000 bar are described for open porosities from 25-38% for use as ring carriers.

SUMMARY

The present invention addresses the problem of suggesting an improved embodiment of an insert part, which in particular enables said part to be infiltrated more effectively.

This problem is solved according to the invention by the objects of the independent claims. Advantageous embodiments represent the respective objects of the dependent claims.

BRIEF DESCRIPTION OF THE DRAWINGS

The FIGURE shows, schematically, an exemplary piston and an insert part.

DETAILED DESCRIPTION

The present invention is based on the general idea of selecting a powder with a completely novel grain composition in the manner of a new screening line for a sinter material for an insert part that can be infiltrated, so that the open porosity and thus also the capacity for being infiltrated of the insert part produced from said sinter material is improved considerably. This is achieved for example by defining the screening line more closely, that is to say the size distribution of the individual sinter particles and thus also making the sinter powder from which the sinter material is created more homogeneous than it usually is. The powder used according to the invention contains at least iron or alloys thereof, preferably also nickel, copper or alloys thereof, and at the same time has particles of different grain sizes, wherein not more than 4 percent by volume of the powder consists of particles that have a diameter smaller than 75 μm. In this context, at least 28% by volume, preferably at least 50% by volume and in a particularly preferred embodiment at least 88% by volume of the powder contains sinter particles with a diameter larger than 150 μm. Consequently, a powdery sinter material may be produced that is coarser than usual, wherein 90% of the sinter particles typically have a diameter smaller than 150 μm. Besides limiting the particles with a diameter smaller than 75 μm to a level not exceeding 4% by volume, the size distribution of the individual particles is defined much more narrowly, wherein the restriction of the grain sizes below the threshold value particularly limits the degree to which pores are clogged, as happened previously, thus rendering the pores unavailable for infiltration. Such a strict limitation of the lower boundary of the particle sizes is not provided in conventional sinter materials, which means that a significantly higher degree of filling is achieved, of the pores remaining between larger sinter particles as well.

According to the invention, the powder used for the sinter material of the insert part has a fraction of 0-4.0% by volume particles with a diameter from 0-75 μm. In one embodiment, particles with a diameter of 75-106 μm account for not more than 10% by volume, preferably not more than 2% by volume of the powder. Additionally, in a particularly preferred embodiment, not more than 6% by volume of the powder includes particles with a diameter in the range from 106-150 μm. Accordingly, in this preferred embodiment at least 88% by volume of the powder has a particle diameter greater than 150 μm. Even with this narrow restriction of the finest components of the powder, it is already possible to ensure that the pores which remain between the individual particles in the sinter material and which can be infiltrated by a subsequent lightweight metal when the lightweight metal piston is cast, are not filled completely, so that these pores are available for infiltration by the lightweight metal, thereby creating a significantly improved bond between the insert part, which may have the form of a ring carrier, a depression border or a bolt eye in a piston, for example.

For this purpose, in one embodiment at least 50% by volume of the powder has a particle diameter of 106-212 μm. The high powder fraction within a relatively narrow grain size bandwidth encourages the formation of a high porosity and thus also of a sinter material that can easily be infiltrated. In another embodiment, particles with diameters larger than 212 μm account for at least 50% by volume thereof. The high percentage of larger particles means that a structure with coarser pores is created, which also facilitates the infiltration.

For practical purposes, a powder that is suitable for producing the sinter material according to the invention has a fraction from 0.5 to 6.0% by volume of particles with a diameter from 106-150 μm. In particular, said lower limit clearly shows that in the case of such a screening line or grain size distribution, very fine particles for completely filling the pores required for infiltration are entirely absent or only present to an inadequate degree. In this way, it may be assured for example that the insert part produced, that is to say sintered, from the sinter material according to the invention has 50-80% pores, that is to say a porosity of 50-80%, which may optionally be filled at least partly by the lightweight metal. If the powder is relatively homogeneous in terms of particle size, not only does this raise the porosity of the sinter material produced, but the individual pores are also substantially larger, which further improves its capacity to allow the molten lightweight metal to flow through it.

In a further advantageous embodiment of the solution according to the invention, at least individual sinter particles of the sinter material are coated with a binder, a resin for example, which increases the green stability and is burned during sintering. After compaction of the green body, however, the resin keeps the sinter particles pressed tightly against each other, thus improving the strength of the compacted green body. Such a resin thus increases the shape fidelity of the initially unsintered insert part, and so facilitates damage-free handling thereof. The binder or resin thus represents a coating of individual particles that reduces the porosity of the insert part, impairing the infiltration and thus also the bonding between the lightweight metal of the piston and the insert part during subsequent casting of the lightweight metal piston. However, the binder burns the resin when the insert part is sintered, making the occupied porosity free again, so that is can be used for the infiltration process. Alternatively, the binder may also be set up so that decomposition takes place in a chemical reaction other than an oxidising reaction during sintering. To this end, another suitable gas, e.g. an endogas, is introduced instead of air during the sintering.

In an advantageous refinement of the solution according to the invention, a density of the insert part is in the range from about 2.5-4.7 g/cm$^3$. The density of aluminium is in the order of about 2.7 g/cm$^3$, for example, so that when the insert part is infiltrate with lightweight metal, aluminium for example, it is always still possible to achieve a density of less than 5 g/cm$^3$. Thus, the high porosity and comparatively low density of the insert part increase the weight of the lightweight metal piston by a considerably smaller amount than a solid cast part manufactured from an iron alloy.

The invention further relates to a method for manufacturing a lightweight metal piston, a magnesium or aluminium piston, for example, using an insert part as described previously, in which the liquid lightweight metal is introduced into a casting mould under a casting pressure of about −0.5-15 bar and the insert part arranged in the casting mould is infiltrated. In a preferred embodiment hypoeutectic alloys of aluminium with silicon and/or copper are used. This prevents the formation of Si or Cu phases, which may occur particularly in a hypereutectic Al alloy. This is undesirable because the sinter material may function like a filter whose pores do not allow these phases to pass through during infiltration, with the result that the phases collect on the surface thereof. The layer formed thereby separates the insert part from the cast piston body and forms a weak point that can result in the part being rejected, or the subsequent failure of the piston. Casting of the lightweight metal piston may be carried out with or without counterpressure, wherein the casting pressure should be at least 0.1 bar higher than the counterpressure.

In a further advantageous embodiment of the solution according to the invention, the lightweight metal piston, for example the aluminium piston is cast under buffer gas, particularly with the use of nitrogen or argon. In this way, it is possible to prevent oxidation of the lightweight metal during casting, wherein such an undesirable oxidation of the lightweight metal can result in clogging of the sinter material pores with oxides, and so may make it more difficult to achieve good infiltration of the insert part and its mechanical bonding with the piston body, as described previously. The use of a buffer gas helps to prevent oxidation, which in turn improves infiltration of the insert part.

It is expedient if the cast piston is solution annealed and/or over-aged. Particularly with aluminium alloys, solution annealing can result in a phenomenon called precipitation hardening, which can help to increase the strength of the lightweight metal piston. In this context, curing may theoretically take place in three stages, that is to say the actual solution annealing, quenching and subsequent aging (hot or cold). Solution annealing is carried out at temperatures from approximately 480° to over 50° C., wherein a temperature is chosen at which a sufficient quantity of the alloy elements has been dissolved in the mixed crystal, so that the hardening effect takes place after quenching and aging. Overaging of such an aluminium alloy may also be carried out in similar fashion.

The casting mould is usually vented while the aluminium piston is cast, to prevent the casting mould from being filled completely, and to be able to achieve an optimised infiltration process of the insert part.

The invention claimed is:

1. An insert part for a cast piston of an internal combustion engine, comprising: a material composed of a powder containing at least iron or alloys thereof, the material having a capacity for being infiltrated, wherein the powder contains particles having different grain sizes and up to 4% by volume of the powder includes particles having a diameter smaller than 75 μm, and wherein the powder further includes a fraction not exceeding 10% by volume of particles having a diameter of 75-106 μm, a fraction ranging from 0.5 to 6.0% by volume of particles with a diameter of 106-150 μm, and a fraction of at least 50% by volume of particles having a diameter greater than 150 μm.

2. The insert part according to claim 1, wherein the fraction of particles with the diameter of 75-106 μm is 2% by volume or less.

3. The insert part according to claim 1, wherein the powder contains a fraction of at least 88% by volume of particles having a diameter greater than 150 μm.

4. The insert part according to claim 1, wherein the powder contains a fraction of at least 50% by volume of particles having a diameter greater than 212 μm.

5. The insert part according to claim 1, wherein the powder further contains at least one of nickel or alloys thereof and copper or alloys thereof.

6. The insert part according to claim 1, wherein at least some individual particles of the powder are coated with a binder configured to facilitate a green stability suitable for handling a compacted green body before sintering and configured to be burned during sintering.

7. The insert part according to claim 1, wherein the material has a porosity of 50-80% by volume.

8. The insert part according to claim 1, wherein the insert part is in the form of a ring carrier, a bolt eye, or a depression border.

9. The insert part according to claim 1, wherein the material has a density of 2.5-4.7 g/cm$^3$.

10. A method for producing an aluminium piston having an insert part, comprising:

providing a sintered powder material containing at least iron or alloys thereof, wherein the sintered powder material includes particles having different grain sizes and up to 4% by volume of the powder includes particles having a diameter smaller than 75 μm, and wherein the sintered powder material further includes a fraction of less than or equal to 10% by volume of particles with a diameter of 75-106 μm, a fraction ranging from 0.5 to 6.0% by volume of particles with a diameter of 106-150 μm, and a fraction of at least 50% by volume of particles having a diameter greater than 150 μm; and introducing a liquid material of an aluminium alloy into a casting mould under a casting pressure of about −0.5 to 15 bar to form at least part of a cast piston, wherein the liquid material of the aluminium alloy infiltrates the sintered powder material arranged in the casting mould.

11. The method according to claim 10, wherein at least one of:

introducing the liquid material of the aluminium alloy takes place under a buffer gas, and introducing the liquid material of the aluminium alloy further includes applying a counterpressure, wherein the counterpressure is 0.1 bar lower than the casting pressure.

12. The method according to claim 10, further comprising at least one of solution annealing the cast piston and over-aging the cast piston.

13. The method according to claim 10, wherein providing the sintered powder material further includes: coating at least some individual particles of the powder with a binder; compacting the powder to form a compacted green body; and heating the compacted green body to burn away the binder.

14. An insert part for a cast piston of an internal combustion engine, comprising: a material having a capacity for being infiltrated and composed of a powder containing at least iron or alloys thereof, the powder containing a size distribution of particles having different grain sizes, wherein the size distribution of particles in the powder includes a fraction of 4% or less by volume of particles having a diameter smaller than 75 μm, a fraction of 10% or less by volume of particles having a diameter of 75-106 μm, a fraction of 0.5 to 6.0% by volume of particles with a diameter of 106-150 μm, and a fraction of at least 28% by volume of particles having a diameter greater than 150 μm.

* * * * *